US009025976B2

(12) United States Patent
Ogino

(10) Patent No.: US 9,025,976 B2
(45) Date of Patent: May 5, 2015

(54) IMAGE FORMING APPARATUS

(71) Applicant: Canon Kabushiki Kaisha, Tokyo (JP)

(72) Inventor: Kosuke Ogino, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/086,073

(22) Filed: Nov. 21, 2013

(65) Prior Publication Data

US 2014/0147135 A1 May 29, 2014

(30) Foreign Application Priority Data

Nov. 26, 2012 (JP) ..... 2012-257502
Sep. 10, 2013 (JP) ..... 2013-187349

(51) Int. Cl.
*G03G 15/00* (2006.01)
*G03G 15/18* (2006.01)
*G03G 15/16* (2006.01)

(52) U.S. Cl.
CPC ..... *G03G 15/161* (2013.01)

(58) Field of Classification Search
CPC ..... G03G 21/0011
USPC ..... 399/38, 72, 154, 394, 49
See application file for complete search history.

(56) References Cited

U.S. PATENT DOCUMENTS

2007/0134013 A1* 6/2007 Soya et al. ..... 399/49
2010/0221024 A1* 9/2010 Funayama et al. ..... 399/46
2011/0280594 A1* 11/2011 Tanaka ..... 399/27

FOREIGN PATENT DOCUMENTS

JP 2001175090 A 6/2001
JP 2007-155750 A 6/2007
JP 2011053515 A 3/2011
JP 2011059626 A 3/2011

* cited by examiner

*Primary Examiner* — Rochelle-Ann J Blackman
(74) *Attorney, Agent, or Firm* — Canon U.S.A., Inc. IP Division

(57) ABSTRACT

An image forming apparatus in which a first toner image to be transferred to a recording medium through secondary transfer is formed on an intermediate transfer member and a second toner image not to be transferred to the recording medium through secondary transfer is formed on the intermediate transfer member after the first toner image has been formed. When the first toner image and the second toner image are formed, a position on the intermediate transfer member at which the second toner image is formed is controlled in accordance with a conveying direction length of the recording medium, to which the first toner image is transferred through secondary transfer, measured by using a detection unit.

20 Claims, 7 Drawing Sheets

IMAGE FORMING APPARATUS

BACKGROUND OF THE INVENTION

1. Field of the Invention

The present invention relates to image forming apparatuses such as copiers and laser beam printers, in which an electrophotographic process is used.

2. Description of the Related Art

In a known image formation method used in a related-art electrophotographic color image forming apparatus, images of different colors are sequentially transferred onto an intermediate transfer belt and then collectively transferred from the intermediate transfer belt to a recording medium, thereby forming an image on the recording medium. When an image is formed in the method as described above, toner remains on the surface of the intermediate transfer belt after the image formed on the intermediate transfer belt has been transferred onto the recording medium. In order to remove this residual toner, a cleaning blade is provided. The cleaning blade is in contact with the intermediate transfer belt so as to scrape the residual toner off the intermediate transfer belt.

In the case where such a cleaning blade is used to scrape off the residual toner, when frictional forces between the cleaning blade and the intermediate transfer belt are large, noise may be generated by vibration of the cleaning blade or image quality may be degraded due to curling of the cleaning blade. In order to address this, Japanese Patent Laid-Open No. 2007-155750 discloses a technology. With this technology, a toner image is formed in a non-image forming region on an intermediate transfer belt so as to supply toner into a nip between the intermediate transfer belt and a cleaning blade. Thus, frictional forces between the cleaning blade and the intermediate transfer belt are reduced, and accordingly, noise or faulty cleaning is suppressed.

A toner image may be formed constantly at a certain timing in a non-image forming region by, similarly to the related-art, forming a toner image used to reduce frictional forces between the cleaning blade and the intermediate transfer belt at a specified timing after an image is formed in accordance with the conveying direction length of a specified recording medium. However, for example, when a recording medium, the conveying direction length of which is longer than that of the specified recording medium, is conveyed, the toner image formed in the non-image forming region may be unintentionally transferred to the recording medium and contaminate the recording medium as illustrated in FIGS. 6A and 6B.

SUMMARY OF THE INVENTION

The present invention related to the present application is proposed in view of the above-described situation and provides an image forming apparatus in which a toner image is formed at an appropriate position in a non-image forming region in accordance with a conveying direction length of a recording medium.

According to an aspect of the present invention, an image forming apparatus includes an image bearing member, a developing unit, a primary transfer unit, a secondary transfer unit, a cleaner, and a detection unit. An electrostatic latent image is formed on the image bearing member. The developing unit is configured to develop the electrostatic latent image formed on the image bearing member into a toner image. The primary transfer unit is configured to transfer the toner image formed on the image bearing member to an intermediate transfer member through primary transfer. The secondary transfer unit is configured to transfer the toner image having been transferred to the intermediate transfer member through primary transfer to a recording medium through secondary transfer. The cleaner is arranged to be in contact with the intermediate transfer member and configured to clean toner on the intermediate transfer member. The detection unit is configured to measure a conveying direction length of the recording medium while the recording medium is being transported. In the image forming apparatus, a first toner image to be transferred to the recording medium through secondary transfer is formed on the intermediate transfer member and a second toner image not to be transferred to the recording medium through secondary transfer is formed on the intermediate transfer member after the first toner image has been formed. When the first toner image and the second toner image are formed, a position on the intermediate transfer member at which the second toner image is formed is controlled in accordance with the conveying direction length of the recording medium, to which the first toner image is transferred through secondary transfer, measured by using the detection unit.

Further features of the present invention will become apparent from the following description of exemplary embodiments with reference to the attached drawings.

DESCRIPTION OF THE EMBODIMENTS

Embodiments of the present invention will be described below with reference to the drawings. It is to be understood that the following embodiments do not limit the invention related to the scope of the claims and that not all the combinations of features described in the embodiments are necessarily required for the solution of the invention.

First Embodiment

Description of Image Forming Apparatus

Figure 1:
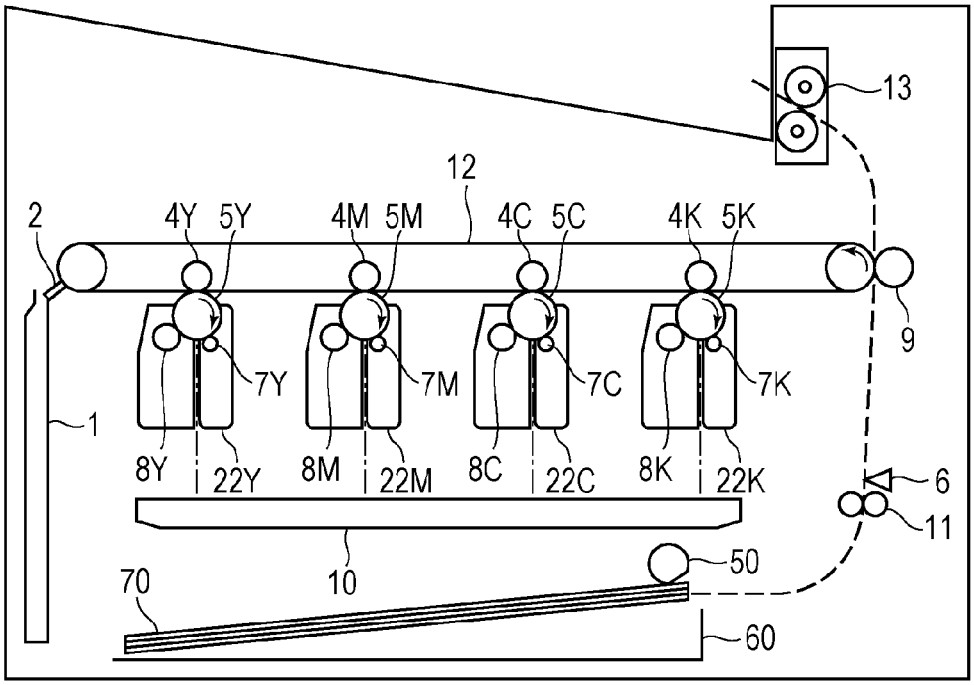
FIG. 1 is a schematic sectional view of an image forming apparatus.

FIG. 1 is a schematic sectional view of an image forming apparatus according to the present invention. The image forming apparatus used in the present invention includes image forming units for four colors, with which a full-color image is formed by superposing four color images, that is, yellow (Y), magenta (M), cyan (C), and black (K) images with one another. Since the image forming units for the respective colors are similarly structured, the notation of sings Y, M, C, and K is omitted in the following description.

Photoconductor drums 5 serving as image bearing members each include an aluminum cylinder and an organic photoconductive layer coated on an outer circumference of the aluminum cylinder. Each photoconductor drum 5 is rotated at a specified circumferential speed by a drive force transmitted from a drive motor (not shown). While being rotated at the specified circumferential speed, the photoconductor drums 5 are each uniformly charged to a specified potential of a specified polarity by a charging roller 7 serving as a charger. An exposure unit 10 serving as an exposure unit irradiates the charged surfaces of the photoconductor drums 5 with laser beams, thereby causing the surface potential of irradiated portions to be changed. Thus, electrostatic latent images are formed on the surfaces of the photoconductor drums 5. The electrostatic latent images having been formed are formed into toner images, which correspond to the respective electrostatic latent images, of the respective colors by developing rollers 8 serving as developing units. The photoconductor drums 5, the charging rollers 7, and the developing rollers 8 are attached to respective cartridges 22, which are detachably attached to the image forming apparatus.

The toner images having been formed on the photoconductor drums 5 are transferred through primary transfer to an intermediate transfer belt 12 serving as an intermediate transfer member by applying a bias to primary transfer rollers 4 serving as primary transfer units. The intermediate transfer belt 12 is disposed at a region opposite the photoconductor drums 5 such that the intermediate transfer belt 12 is in contact with the photoconductor drums 5 and rotated at the substantially same circumferential speed as that of the photoconductor drums 5. The toner images formed on the respective photoconductor drums 5 are sequentially transferred through primary transfer from the yellow toner image while passing through the nips between the intermediate transfer belt 12 and the photoconductor drums 5. Thus, a color image is formed by superposing the toner images of a plurality of colors with one another on the intermediate transfer belt 12. After primary transfer has been performed, residual toner remaining on the surface of the intermediate transfer belt 12 is cleaned by a cleaning blade 2 serving as a cleaner and accumulated in a waste toner container 1. The cleaning blade 2 is in contact with the intermediate transfer belt 12. The residual toner is cleaned by scraping the residual toner off the intermediate transfer member with the cleaning blade 2.

The toner images having been transferred onto the intermediate transfer belt 12 are transferred onto a recording medium 70 in a secondary transfer unit that includes the intermediate transfer belt 12 and a secondary transfer roller 9 serving as a secondary transfer unit. The recording medium 70 is a sheet of paper fed by a sheet feed roller 50 from a sheet supplying cassette 60 serving as a sheet supplying unit. The recording medium 70 having been fed by the sheet feed roller 50 is conveyed toward the secondary transfer unit by a registration roller pair 11. A registration sensor 6 is provided downstream of the registration roller pair 11. The registration sensor 6 detects timing of leading edge of the recording medium 70 and timing of the trailing edge of the recording medium 70. The sheet feed roller 50 and the registration roller pair 11 are rotated by drive forces transmitted from drive motors (not shown), thereby conveying the recording medium 70.

The recording medium 70, onto which the toner images have been transferred by the secondary transfer unit, undergoes thermal fixing of the toner images with heat and pressure in a fixing device 13 serving as a fixing unit. After that, the recording medium 70 is ejected to a sheet output unit disposed in an upper portion of the image forming apparatus. Through the above-described operation, a full-color image is formed.

Description of Control Block Diagram

Figure 2:
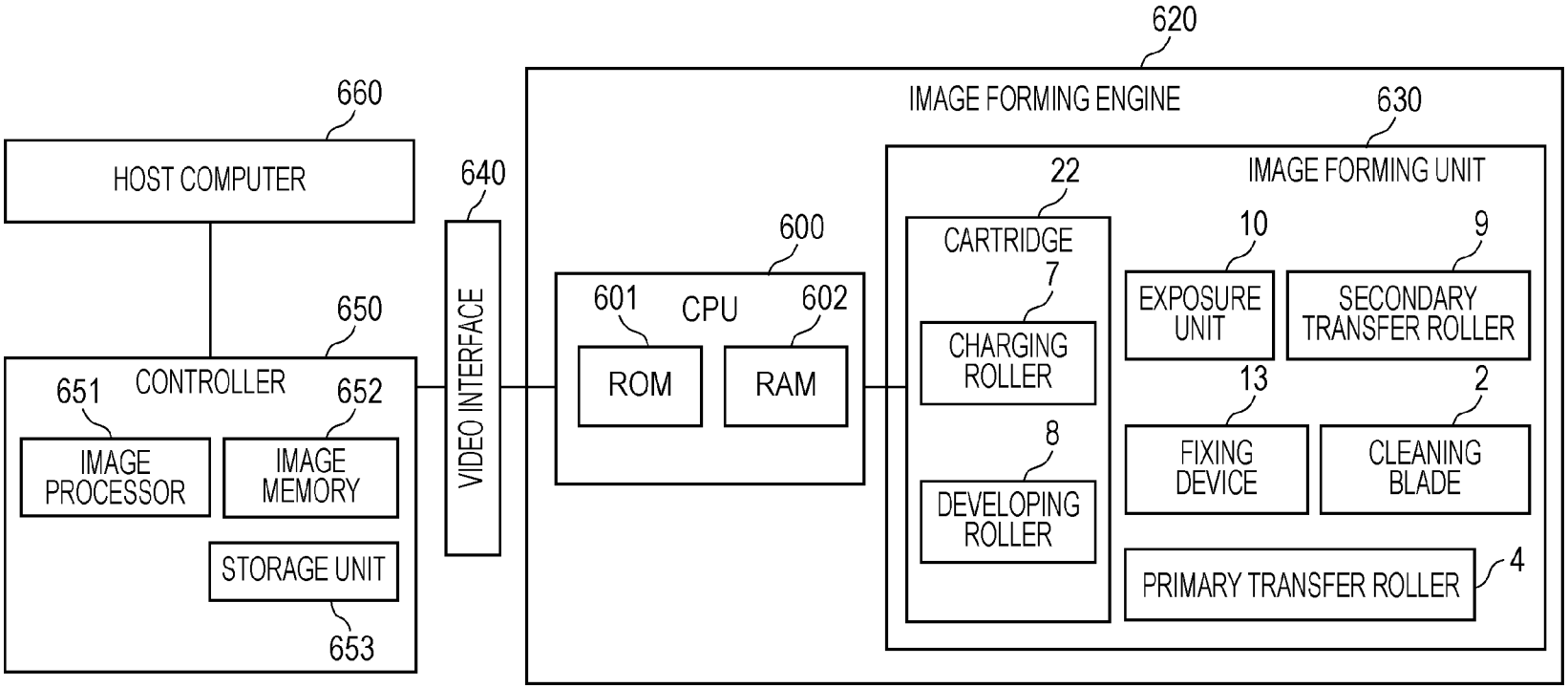
FIG. 2 is a control block diagram that explains a system configuration of the image forming apparatus.

Referring to FIG. 2, a control block diagram that explains a system configuration of the image forming apparatus is described. A controller 650 connected to a host computer 660 issues a command for image formation to an image forming engine 620 through a video interface 640. The controller 650 includes an image processor 651, an image memory 652, and a storage unit 653. The image processor 651 converts an image transmitted from the host computer 660 into image information that can be received by the image forming engine 620. The image memory 652 stores the image information processed by the image processor 651. Internal information of the controller 650, sample images held by the controller 650, and the like are saved in the storage unit 653. When forming an image, the image information having undergone image processing in the image processor 651 is loaded in the image memory 652, and the image information in the image memory 652 is output to the image forming engine 620 through the video interface 640 in response to an image output request from the image forming engine 620.

An image forming unit 630 of the image forming engine 620 includes the cartridges 22, the exposure unit 10, the primary transfer rollers 4, the secondary transfer roller 9, the cleaning blade 2, the fixing device 13, and the like. The cartridges 22 each include the charging roller 7 and the developing roller 8.

A CPU 600 obtains a conveying direction length of an image forming region (may instead be an assumed recording medium 70) from the controller 650 through the video interface 640. The CPU 600 determines image formation start timing of a toner image to be transferred onto the recording medium 70 in accordance with the obtained conveying direction length and a preset interval between the recording media. Then, the CPU 600 transmits an image formation start signal (/TOP signal) to the controller 650 through the video interface 640 in accordance with the determined image formation timing of the toner image. The /TOP signal is a signal for determining the image output timing. That is, the CPU 600 requests an image signal from the controller 650 by transmitting the /TOP signal. Furthermore, the CPU 600 calculates the conveying direction length of the recording media 70 loaded in the sheet supplying cassette 60 in accordance with detection timing at which the leading edge of the recording medium is detected and timing at which the trailing edge of the recording medium is detected by the registration sensor 6 when image formation is performed on the first recording medium 70 after the recording media 70 have been loaded in the sheet supplying cassette 60.

The CPU 600 executes control of image formation while controlling the components of the image forming unit 630 in accordance with control programs stored in a ROM 601 using a RAM 602 as a work space. Although image formation control is performed in accordance with processes performed by the CPU 600 in the above description, part or all of the control performed by the CPU 600 may be performed by an application specific integrated circuit (ASIC).

Toner Supply Operation for Toner Cleaning Blade

Hereafter, a toner image formed in a toner supply operation to supply toner to the cleaning blade 2 and not transferred onto a recording medium is defined as a cleaning toner image, and a toner image formed by an ordinary image formation and transferred to a recording medium is defined as a recording image. The cleaning toner image is formed as a halftone image having a maximum width in a developing area in the main scanning direction. The cleaning toner image may be formed of all of the four color toners, three or two color toners, or one color out of the four color toners.

As described above, due to the /TOP signal being output to the controller 650 through the video interface 640 at timing when the image forming engine 620 is ready for image formation, the image information in the image memory 652 is output, thereby the recording image is formed. Likewise, the cleaning toner image is formed by outputting image information in the image memory 652 in response to the /TOP signal. Image information of the cleaning toner image is stored in advance in the storage unit 653 of the controller 650.

The recording image having been formed is transferred onto the recording medium 70 by the secondary transfer roller 9 through application of a secondary transfer bias, the polarity of which is different from that of toner, when the recording medium 70 exists in the secondary transfer unit. Regarding the cleaning toner image, the secondary transfer bias, the polarity of which is the same as that of toner, is applied by the secondary transfer roller 9 to the formed cleaning toner image in a state in which the recording medium 70 does not exist in the secondary transfer unit. Thus, the cleaning toner image is supplied to the cleaning blade 2 without transference of toner in the secondary transfer unit. By doing this, frictional forces between the cleaning blade 2 and the surface of the intermediate transfer belt 12 can be reduced, thereby preventing chattering or curling of the cleaning blade 2 from occurring. Thus, good cleaning performance can be maintained.

Image Formation Timing of Cleaning Toner Image

Figure 3A:
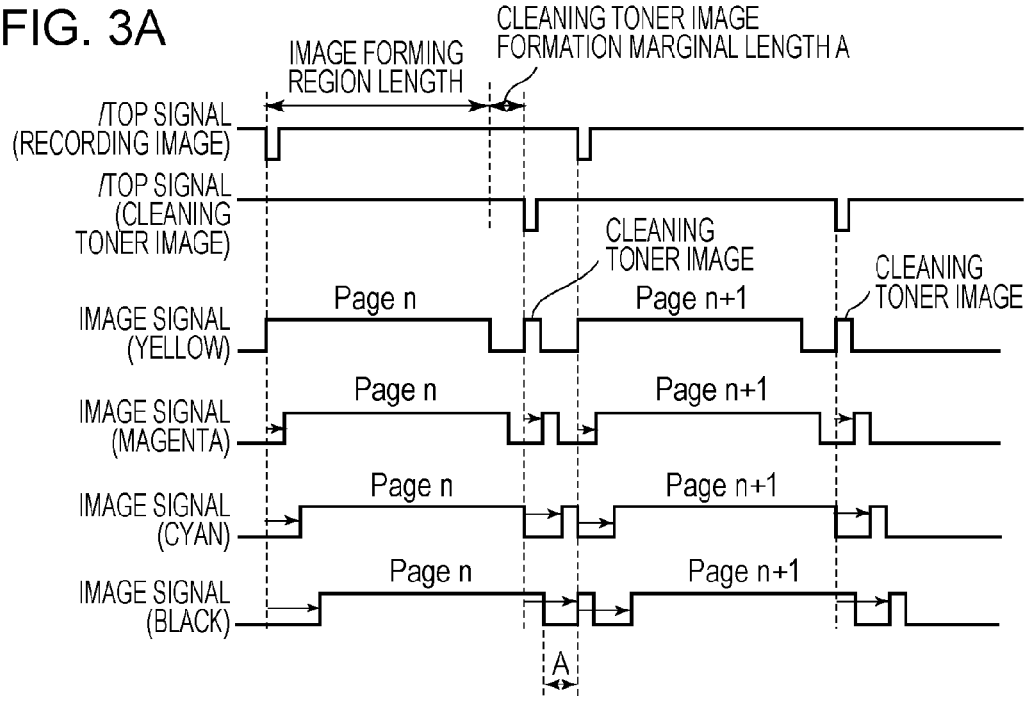
FIGS. 3A to 3C illustrate timing at which a cleaning toner image is formed.

Next, timing at which the cleaning toner image is formed in the present embodiment is described with reference to FIGS. 3A to 3C. FIG. 3A is a timing chart illustrating timing at which a related-art cleaning toner image is formed. After outputting the /TOP signal (recording image) for forming the recording image serving as a first toner image, the image forming apparatus outputs the /TOP signal (cleaning toner image) for forming the cleaning toner image serving as a second toner image in accordance with the conveying direction length of the recording image to be formed. The /TOP signal (cleaning toner image) is output at the following timing:

/TOP signal (cleaning toner image)=conveying direction length of recording image to be formed+cleaning toner image formation marginal length *A*.

The cleaning toner image formation marginal length A is a margin with which the position where the cleaning toner image is formed is determined such that the cleaning toner image is not transferred onto the recording medium 70. The cleaning toner image formation marginal length A extends to a position separated from the trailing edge of the recording medium 70 by a specified length. The cleaning toner image formation marginal length A is preset in accordance with time to switch the polarity of the secondary transfer bias or the like. The cleaning toner image formation marginal length A can be appropriately set with consideration of the conditions such as an image formation interval or a sheet interval. By determining output timing of the /TOP signal (cleaning toner image) as described above, the cleaning toner image can be constantly formed at a position separated from the recording image by a certain interval. However, there is a possibility of the cleaning toner image being transferred onto the recording medium 70 depending on the conveying direction length of the recording medium 70.

Figure 3B:
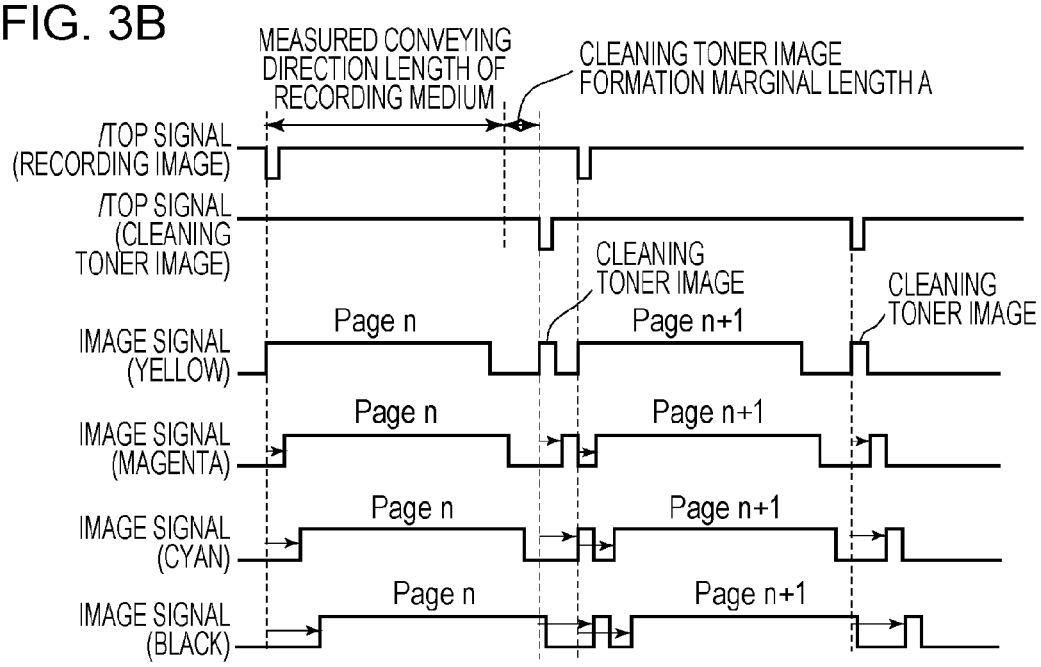
Figure 3C:
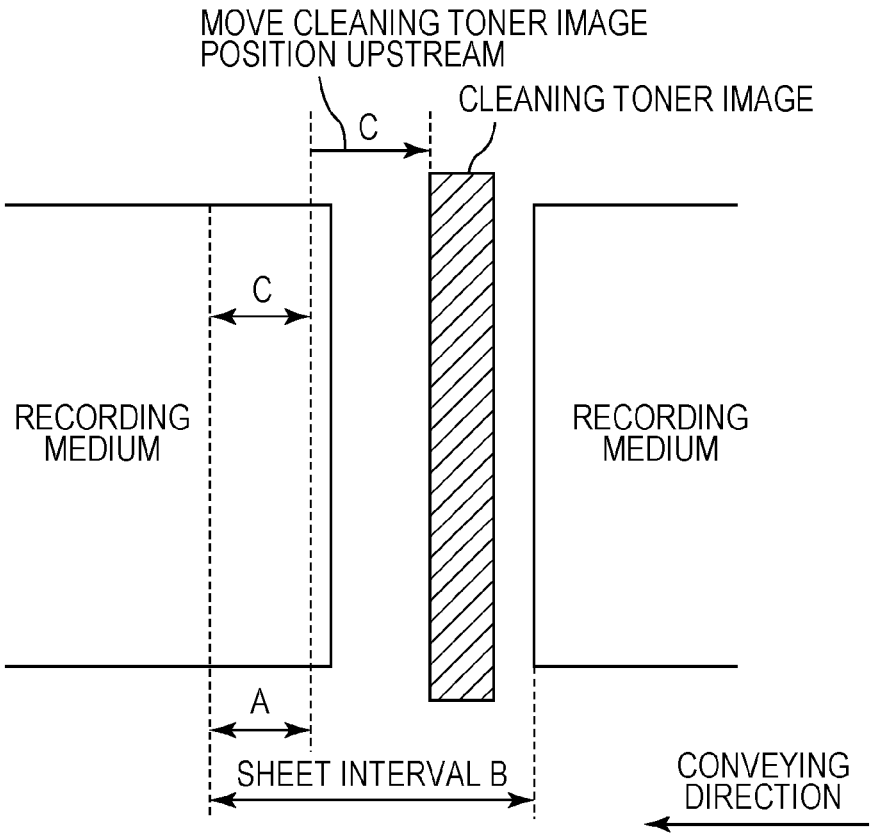

FIG. 3B is a timing chart illustrating timing at which the cleaning toner image is formed according to the present embodiment. After outputting the /TOP signal (recording image), the image forming engine 620 outputs the /TOP signal (cleaning toner image) in accordance with the conveying direction length of the recording medium 70 calculated from detection timing at which the leading edge of the recording medium 70 is detected and timing at which the trailing edge of the recording medium 70 is detected by the registration sensor 6. The /TOP signal (cleaning toner image) is output at the following timing:

/TOP signal (cleaning toner image)=conveying direction length of recording medium 70+cleaning toner image formation marginal length *A*.

Here, it is assumed that the conveying direction length of the recording medium 70 has been measured before the cleaning toner image is formed. When the conveying direction length of the recording medium 70 has not been measured, the /TOP signal (cleaning toner image) is not output. When the conveying direction length of the recording medium 70 is not determined, forming the cleaning toner image may lead to contamination of the recording medium 70. Thus, transference of the cleaning toner image onto the recording medium 70 is prevented by not forming the cleaning toner image. However, when a situation in which the conveying direction length of the recording medium 70 is not determined repeatedly occurs with a specified number of sheets, the cleaning toner image is not supplied to the cleaning blade 2. This may cause the cleaning blade 2 to chatter or generate noise. In order to address this, when the cleaning toner image cannot be formed while the recording images are formed on a specified number of sheets, a cleaning toner image formation mode is entered. In the cleaning toner image formation mode, the cleaning toner image is formed without conveying the recording medium 70, thereby supplying the toner to the cleaning blade 2.

As described above, the cleaning toner image formation marginal length A is determined in accordance with the measured conveying direction length of the recording medium 70. Thus, even when, for example, the recording medium 70, the conveying direction length of which is longer than that specified in advance by the user, is loaded in the sheet supplying cassette 60, as illustrated in FIG. 3C, the cleaning toner image can be formed at a position at which the cleaning toner image is not transferred onto the recording medium 70. Accordingly, contamination of the recording medium 70 with the cleaning toner image can be suppressed.

Although the cleaning toner image is used as an example in the description of the present embodiment, application of the technology is not limited to the cleaning toner image. The control according to the present embodiment may also be applied to a toner image formed after a recording image has been formed such as, for example, a patch for image density correction used to correct image density and a patch for color misregistration correction used to correct color misregistration of an image. As a method of changing image formation start timing of the cleaning toner image, a method of changing output timing of the /TOP signal (cleaning toner image) has been described. However, the method of changing image formation start timing is not limited to this. For example, the controller 650 may change image formation timing of the cleaning toner image in accordance with the conveying direction length of the recording medium 70 received from the image forming engine 620. The image forming engine 620 may mask the image signal of the cleaning toner image output from the controller 650 so as not to transfer the cleaning toner image onto the recording medium 70.

In the present embodiment, the registration sensor 6 is provided to detect the conveying direction length of the recording medium 70. However, the conveying direction length of the recording medium 70 is not necessarily measured by using the registration sensor 6. Any method may be used as long as the conveying direction length of the recording medium 70 can be measured. For example, a regulating plate used to measure the conveying direction length of the recording medium 70 may be provided in the sheet supplying cassette 60.

Second Embodiment

In a second embodiment, a method is described, in which the length of the cleaning toner image to be formed is changed after the position where the cleaning toner image has been determined in accordance with the conveying direction length of the recording medium 70. The description of elements similar to those of the foregoing first embodiment is omitted from description of the second embodiment.

Image Formation Timing of Cleaning Toner Image

Figure 4A:
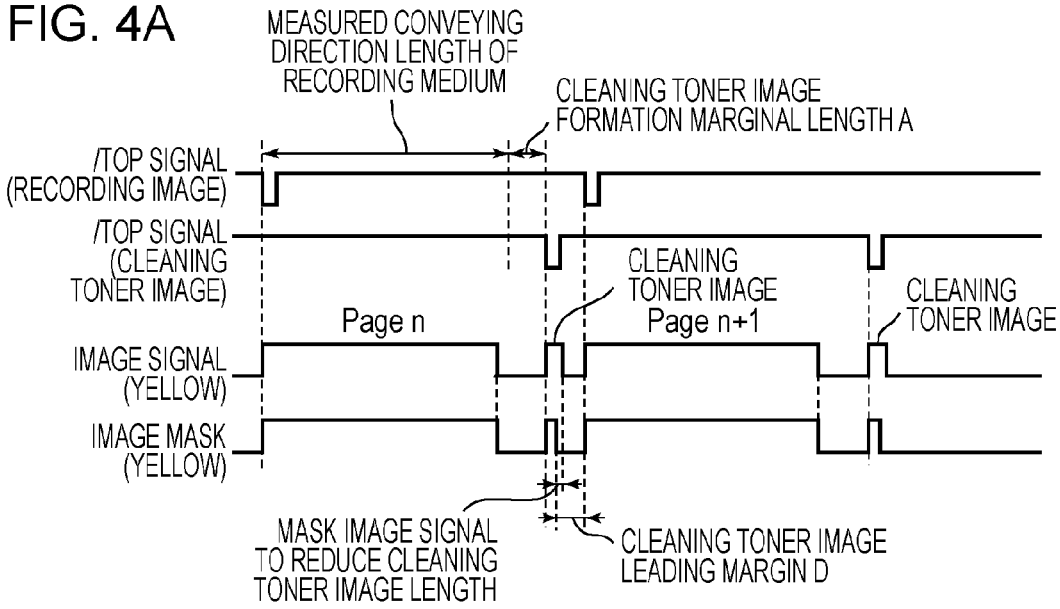
FIGS. 4A and 4B illustrate timing at which the cleaning toner image is formed.
Figure 4B:
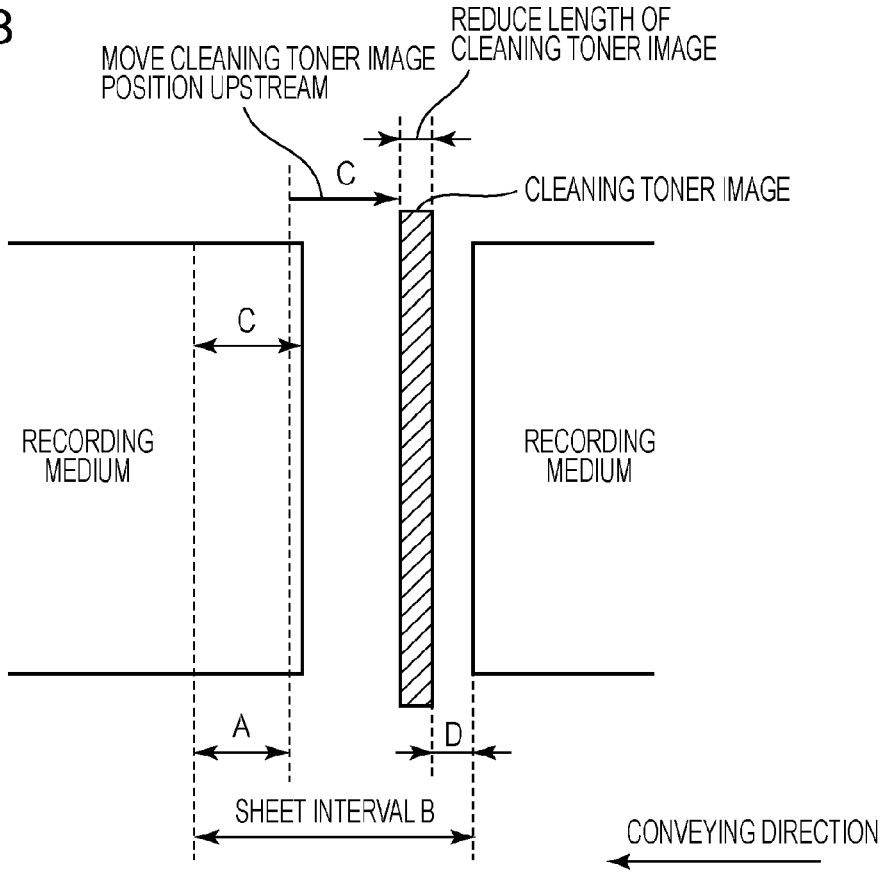

Timing at which the cleaning toner image is formed in the present embodiment is described with reference to FIGS. 4A and 4B. FIG. 4A is a timing chart illustrating timing at which the cleaning toner image is formed according to the present embodiment. For simplification of description, only formation of the yellow cleaning toner image is illustrated in FIG. 4A. Formation of the cleaning toner images of the other colors can be similarly controlled except for image formation timing. Image formation timing of each of the non-yellow color cleaning toner images is different from that of the yellow color toner cleaning toner image by a specified period of time.

After outputting the /TOP signal (recording image), the image forming engine 620 outputs the /TOP signal (cleaning toner image) in accordance with the conveying direction length of the recording medium 70 calculated from detection timing at which the leading edge of the recording medium 70 is detected and detection timing at which the trailing edge of the recording medium 70 is detected by the registration sensor 6. The /TOP signal (cleaning toner image) is output at the following timing:

/TOP signal (cleaning toner image)=conveying direction length of recording medium 70+cleaning toner image formation marginal length *A*.

The image forming engine 620 clears an image mask at the same time as it transmits the /TOP signal (cleaning toner image), thereby permitting the cleaning toner image to be formed. Then, the image mask is set in accordance with output timing of the /TOP signal (next recording image), which is for forming the next recording image serving as a third toner image. Thus, the conveying direction length of the cleaning toner image is controlled. The image mask for the cleaning toner image is cleared and set at the following timing:

Clearing of image mask (cleaning toner image)=/TOP signal (cleaning toner image), and Setting of image mask (cleaning toner image)=/TOP signal (next recording image) for forming next recording image−cleaning toner image leading margin *D*.

The cleaning toner image leading margin D is a margin set so that the cleaning toner image is not transferred onto the next recording medium 70. The cleaning toner image leading margin D is preset in accordance with time to switch the polarity of the secondary transfer bias or the like.

As described above, the cleaning toner image formation marginal length A is determined in accordance with the conveying direction length of the previous recording medium 70. Thus, even when, for example, the recording medium 70, the conveying direction length of which is longer than that specified in advance by the user, is loaded in the sheet supplying cassette 60, as illustrated in FIG. 4B, the cleaning toner image can be formed at a position at which the cleaning toner image is not transferred onto the trailing end of the previous recording medium 70. Furthermore, since the conveying direction length of the cleaning toner image is determined in accordance with timing at which the next recording image is formed, the cleaning toner image can be formed to have such a conveying direction length that the cleaning toner image is not transferred onto a leading end portion of the next recording medium 70. Accordingly, contamination of the recording medium 70 with the cleaning toner image can be suppressed.

Third Embodiment

In a third embodiment, a method is described, in which the position where the recording image to be formed next is determined in accordance with the recording medium 70 after the position where the cleaning toner image is formed has been determined in accordance with the conveying direction length of the recording medium 70. Description of elements similar to those of the foregoing first or second embodiment is omitted from description of the third embodiment.

Figure 5A:
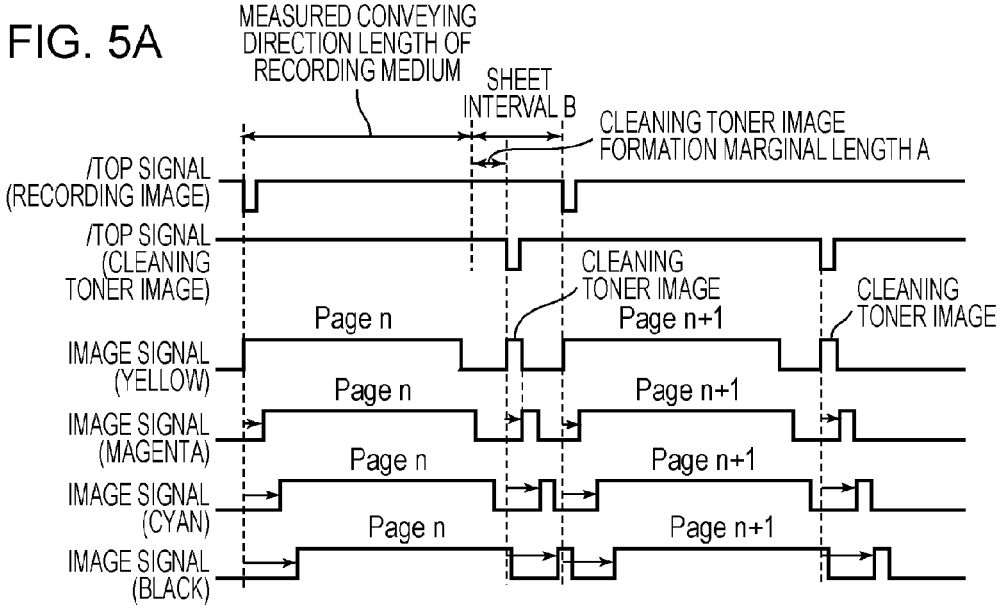
FIGS. 5A and 5B illustrate timing at which the cleaning toner image is formed and timing at which a next recording image is formed.
Figure 5B:
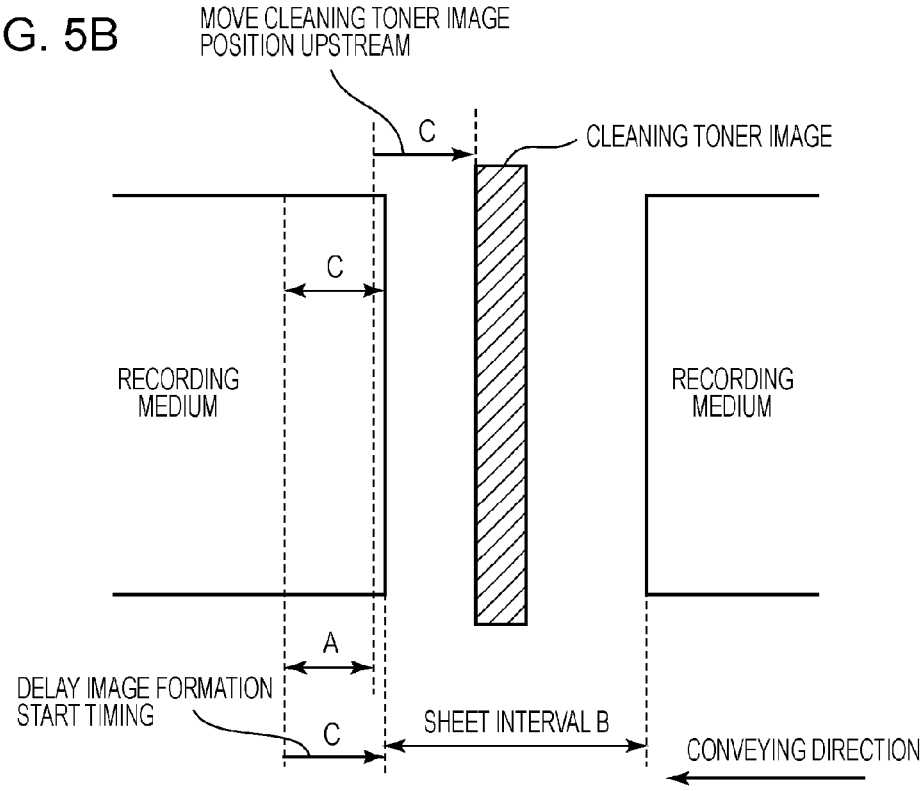
Figure 6A:
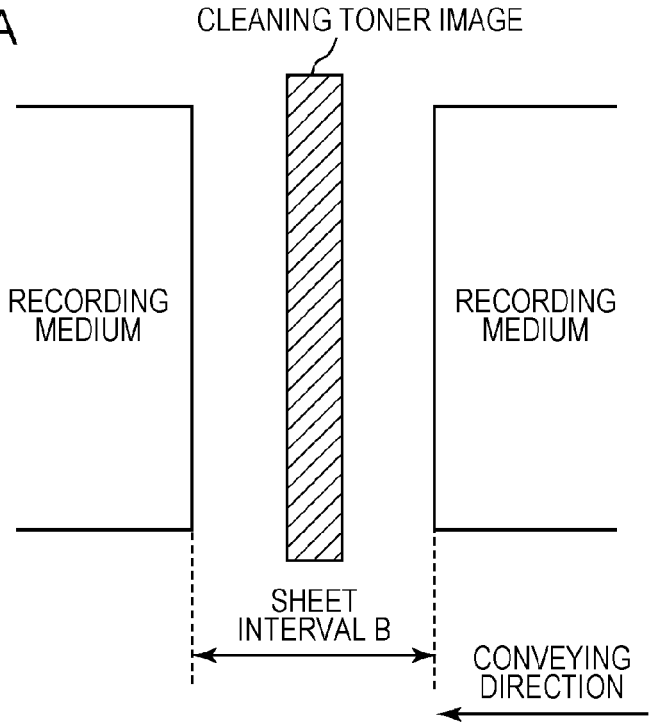
FIGS. 6A and 6B explains a situation in which a toner image formed in a non-image forming region is unintentionally transferred to a recording medium and contaminates the recording medium.
Figure 6B:
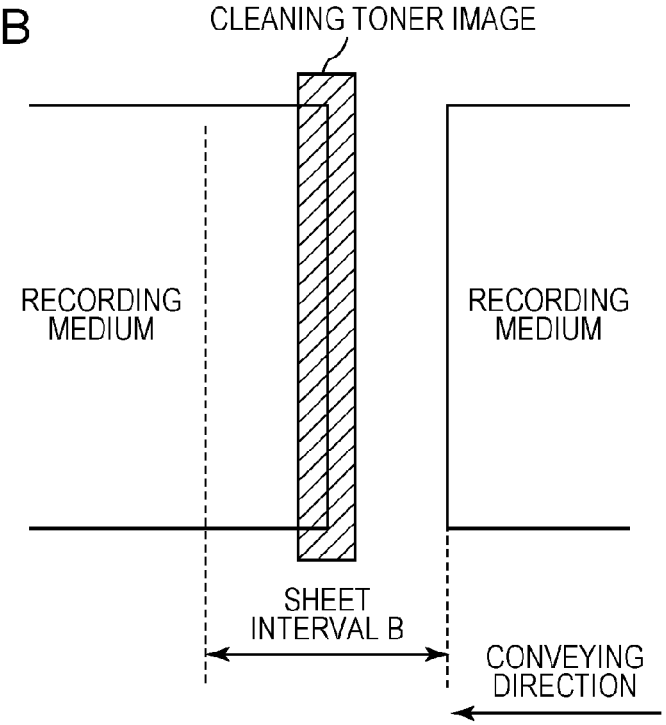

Image Formation Timing of Cleaning Toner Image and Recording Image to be Formed Next Timing at which the cleaning toner image is formed and timing at which the next recording image is formed in the present embodiment are described with reference to FIGS. 5A and 5B. FIG. 5A is a timing chart illustrating timing at which the cleaning toner image is formed and timing at which the next recording image is formed according to the present embodiment. After outputting the /TOP signal (recording image) for forming the recording image on the previous recording medium 70, the image forming engine 620 outputs the /TOP signal (cleaning toner image) in accordance with the conveying direction length of the recording medium 70 calculated from detection timing at which the leading edge of the recording medium 70 is detected and detection timing at which the trailing edge of the recording medium 70 is detected by the registration sensor 6. The /TOP signal (cleaning toner image) is output at the following timing:

/TOP signal (cleaning toner image)=conveying direction length of recording medium 70+cleaning toner image formation marginal length *A*.

After that, the image forming engine 620 outputs the next /TOP signal (next recording image) in accordance with the conveying direction length of the previous recording medium 70 and the preset sheet interval. The /TOP signal (next recording image) is output at the following timing:

/TOP signal (next recording image)=conveying direction length of previous recording medium 70+sheet interval *B*.

As described above, timing at which the /TOP signal for the next recording image is output can be appropriately set in accordance with the length of the previous recording medium 70. Thus, even when, for example, the recording medium 70, the conveying direction length of which is longer than that specified in advance by the user, is loaded in the sheet supplying cassette 60, as illustrated in FIG. 5B, the cleaning toner image can be formed at a position at which the cleaning toner image is not transferred onto either of the trailing end portion of the previous recording medium 70 and the leading end portion of the next recording medium 70. Accordingly, contamination of the recording medium 70 with the cleaning toner image can be suppressed.

Variants

Referring to FIG. 1, although an intermediate transfer type image forming apparatus is described as an example of the image forming apparatus, the image forming apparatus is not limited to this. For example, control according to the foregoing first to third embodiments can also be performed on a direct transfer type image forming apparatus, in which a toner image formed on the photoconductor drums 5 is directly transferred onto the recording medium.

Referring to FIG. 1, although an image forming apparatus that forms color images is described as an example of the image forming apparatus, the image forming apparatus is not limited to this. For example, control according to the foregoing first to third embodiments can also be performed on a monochrome image forming apparatus that includes a single photoconductor drum 5. In this case, a black toner image is formed on the photoconductor drum 5, and the formed black toner image is recorded.

In both a direct transfer type and monochrome image forming apparatuses, control according to, for example, the foregoing first embodiment is performed as follows: after outputting the /TOP signal (recording image), the image forming engine 620 outputs the /TOP signal (cleaning toner image) in accordance with the conveying direction length of the recording medium 70 calculated from detection timing at which the leading edge of the recording medium 70 is detected and detection timing at which the trailing edge of the recording medium 70 is detected by the registration sensor 6. The /TOP signal (cleaning toner image) is output at the following timing:

/TOP signal (cleaning toner image)=conveying direction length of recording medium 70+cleaning toner image formation marginal length *A*.

By performing control as described above similarly to the intermediate transfer type image forming apparatus, the cleaning toner image formation marginal length is determined in accordance with the measured conveying direction length of the recording medium 70. Thus, even when, for example, the recording medium 70, the conveying direction length of which is longer than that specified in advance by the user, is loaded in the sheet supplying cassette 60, as illustrated in FIG. 3C, the cleaning toner image can be formed at a position at which the cleaning toner image is not transferred onto the recording medium 70. Accordingly, contamination of the recording medium 70 with the cleaning toner image can be suppressed. Although the second and third embodiments, which have been described in detail above, is omitted from description here, control similar to that performed on the intermediate transfer type image forming apparatus can also be performed on the direct transfer type and monochrome image forming apparatuses as described above.

With the structure according to the present invention, a toner image can be formed at an appropriate position of a non-image forming region in accordance with the conveying direction length of a recording medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-257502, filed Nov. 26, 2012, and Japanese Patent Application No. 2013-187349, filed Sep. 10, 2013, which are hereby incorporated by reference herein in their entirety.

What is claimed is:

1. An image forming apparatus comprising:

an image bearing member, an electrostatic latent image being formed on the image bearing member;

a developing unit configured to develop the electrostatic latent image formed on the image bearing member into a toner image;

a primary transfer unit configured to transfer the toner image formed on the image bearing member to an intermediate transfer member through primary transfer;

a secondary transfer unit configured to transfer the toner image having been transferred to the intermediate transfer member through primary transfer to a recording medium through secondary transfer;

a cleaner arranged to be in contact with the intermediate transfer member and configured to clean toner on the intermediate transfer member; and a detection unit configured to measure a conveying direction length of the recording medium, wherein a first toner image to be transferred to the recording medium through secondary transfer is formed on the intermediate transfer member and a second toner image not to be transferred to the recording medium through secondary transfer is formed on the intermediate transfer member after the first toner image has been formed, and wherein, when the first toner image and the second toner image are formed, a position on the intermediate transfer member at which the second toner image is formed and a length of the second toner image are is controlled in accordance with the conveying direction length of the recording medium, to which the first toner image is transferred through secondary transfer, measured by using the detection unit.

2. The image forming apparatus according to claim 1, wherein the second toner image is formed at a position separated by a specified length from a trailing end of the recording medium detected by the detection unit.

3. The image forming apparatus according to claim 1, wherein a third toner image is formed after the second toner image has been formed and the third toner image is transferred through secondary transfer to a recording medium that follows the recording medium to which the first toner image is transferred through secondary transfer, and wherein a length of the second toner image is controlled in accordance with a position from which the formation of the third toner image starts.

4. The image forming apparatus according to claim 1, wherein a third toner image is formed after the second toner image has been formed and the third toner image is transferred through secondary transfer to a recording medium that follows the recording medium to which the first toner image is transferred through secondary transfer, and wherein a position where the third toner image is formed is controlled in accordance with the conveying direction length of the recording medium, to which the first toner image is transferred through secondary transfer, measured by using the detection unit.

5. The image forming apparatus according to claim 1, further comprising:

an engine that controls formation of the toner images; and a controller that transmits image information for forming the toner images to the engine, wherein a position where the second toner image is formed is controlled by controlling timing at which the engine transmits to the controller a signal that requests image information, and wherein the timing is controlled in accordance with the conveying direction length of the recording medium, to which the first toner image is transferred through secondary transfer, measured by using the detection unit.

6. The image forming apparatus according to claim 1, further comprising:

an engine that controls formation of the toner images; and a controller that transmits image information for forming the toner images to the engine, wherein a position where the second toner image is formed is controlled by controlling timing at which the controller transmits the image information to the engine, and wherein the timing is controlled in accordance with the conveying direction length of the recording medium, to which the first toner image is transferred through secondary transfer, measured by using the detection unit.

7. The image forming apparatus according to claim 4, further comprising:

an engine that controls formation of the toner images; and a controller that transmits image information for forming the toner images to the engine, wherein a position where the third toner image is formed is controlled by controlling timing at which the engine transmits to the controller a signal that requests image information, and wherein the timing is controlled in accordance with the conveying direction length of the recording medium, to which the first toner image is transferred through secondary transfer, measured by using the detection unit.

8. The image forming apparatus according to claim 4, further comprising:

an engine that controls formation of the toner images; and a controller that transmits image information for forming the toner images to the engine, wherein a position where the third toner image is formed is controlled by controlling timing at which the controller transmits the image information to the engine, and wherein the timing is controlled in accordance with the conveying direction length of the recording medium, to which the first toner image is transferred through secondary transfer, measured by using the detection unit.

9. The image forming apparatus according to claim 1, wherein the second toner image is a toner image that supplies toner to the cleaner, a toner image used for density correction, or a toner image used for color misregistration correction.

10. The image forming apparatus according to claim 1, further comprising:

a manual feed tray, the recording medium being loaded in the manual feed tray, wherein the conveying direction length of the recording medium fed from the manual feed tray is measured by using the detection unit.

11. An image forming apparatus comprising:

an image bearing member, an electrostatic latent image being formed on the image bearing member;

a developing unit configured to develop the electrostatic latent image formed on the image bearing member into a toner image;

a transfer unit configured to transfer the toner image formed on the image bearing member to a recording medium; and a detection unit configured to measure a conveying direction length of the recording medium, wherein a first toner image to be transferred to the recording medium is formed on the image bearing member and a second toner image is formed on the image bearing member after the first toner image has been formed, and wherein, when the first toner image and the second toner image are formed, a position on the image bearing member at which the second toner image is formed and a length of the second toner image are controlled in accordance with the conveying direction length of the recording medium, to which the first toner image is transferred, measured by using the detection unit.

12. The image forming apparatus according to claim 11, wherein the second toner image is formed at a position separated by a specified length from a trailing end of the recording medium detected by the detection unit.

13. The image forming apparatus according to claim 11, wherein a third toner image is formed after the second toner image has been formed and the third toner image is transferred to a recording medium that follows the recording medium to which the first toner image is transferred, and wherein a length of the second toner image is controlled in accordance with a position from which the formation of the third toner image starts.

14. The image forming apparatus according to claim 11, wherein a third toner image is formed after the second toner image has been formed and the third toner image is transferred to a recording medium that follows the recording medium to which the first toner image is transferred, and wherein a position where the third toner image is formed is controlled in accordance with the conveying direction length of the recording medium, to which the first toner image is transferred, measured by using the detection unit.

15. The image forming apparatus according to claim 11, further comprising:

an engine that controls formation of the toner images; and a controller that transmits image information for forming the toner images to the engine, wherein a position where the second toner image is formed is controlled by controlling timing at which the engine transmits to the controller a signal that requests image information, and wherein the timing is controlled in accordance with the conveying direction length of the recording medium, to which the first toner image is transferred, measured by using the detection unit.

16. The image forming apparatus according to claim 11, further comprising:

an engine that controls formation of the toner images; and a controller that transmits image information for forming the toner images to the engine, wherein a position where the second toner image is formed is controlled by controlling timing at which the controller transmits the image information to the engine, and wherein the timing is controlled in accordance with the conveying direction length of the recording medium, to which the first toner image is transferred, measured by using the detection unit.

17. The image forming apparatus according to claim 14, further comprising:

an engine that controls formation of the toner images; and a controller that transmits image information for forming the toner images to the engine, wherein a position where the third toner image is formed is controlled by controlling timing at which the engine transmits to the controller a signal that requests image information, and wherein the timing is controlled in accordance with the conveying direction length of the recording medium, to which the first toner image is transferred, measured by using the detection unit.

18. The image forming apparatus according to claim 14, further comprising:

an engine that controls formation of the toner images; and a controller that transmits image information for forming the toner images to the engine, wherein a position where the third toner image is formed is controlled by controlling timing at which the controller transmits the image information to the engine, and wherein the timing is controlled in accordance with the conveying direction length of the recording medium, to which the first toner image is transferred, measured by using the detection unit.

19. The image forming apparatus according to claim 11, further comprising:

a cleaner arranged to be in contact with the image bearing member and configured to clean toner on the image bearing member, wherein the second toner image is a toner image that supplies toner to the cleaner, a toner image used for density correction, or a toner image used for color misregistration correction.

20. The image forming apparatus according to claim 11, further comprising:

a manual feed tray, the recording medium being loaded in the manual feed tray, wherein the conveying direction length of the recording medium fed from the manual feed tray is measured by using the detection unit.

* * * * *